US007886927B2

(12) United States Patent
Frey et al.

(10) Patent No.: US 7,886,927 B2
(45) Date of Patent: Feb. 15, 2011

(54) CONTAINER COVER FOR CONTAINER WITH EDGE PROTRUSION

(75) Inventors: Robert E. Frey, Villa Hills, KY (US); Hartmut K. Geisselbrecht, Villa Hills, KY (US)

(73) Assignee: Sonoco Development, Inc., Hartsville, SC (US)

( * ) Notice: Subject to any disclaimer, the term of this patent is extended or adjusted under 35 U.S.C. 154(b) by 1591 days.

(21) Appl. No.: 11/021,954

(22) Filed: Dec. 22, 2004

(65) Prior Publication Data

US 2006/0138136 A1 Jun. 29, 2006

(51) Int. Cl.

| | |
|---|---|
| ***B65D 51/18*** | (2006.01) |
| ***B65D 39/00*** | (2006.01) |
| ***B65D 41/00*** | (2006.01) |
| ***B65D 1/42*** | (2006.01) |
| ***B65D 43/14*** | (2006.01) |

(52) U.S. Cl. ..... 220/254.3; 220/359.1; 220/787; 220/810; 220/658; 220/837; 220/844; 229/125.08; 229/125.25

(58) Field of Classification Search ..... 220/787, 220/786, 791, 792, 789, 620, 658, 615, 793, 220/784, 799, 800, 802, 836–839, 359.1, 220/380, 780, 785, 844, 810; 229/124, 125.08, 229/125.09, 125.25

See application file for complete search history.

(56) References Cited

U.S. PATENT DOCUMENTS

| | | | | |
|---|---|---|---|---|
| 2,764,199 | A | 9/1956 | Tupper | |
| 3,095,995 | A | 7/1963 | Foster | |
| 3,122,287 | A | 2/1964 | Makowski | |
| 3,165,227 | A * | 1/1965 | Muoio et al. | 220/800 |
| 3,297,192 | A | 1/1967 | Swett | |
| 3,675,812 | A | 7/1972 | Foster | |
| 3,900,129 | A * | 8/1975 | Scholz | 220/784 |
| 4,059,201 | A | 11/1977 | Foster | |
| 4,491,252 | A | 1/1985 | Schmidt et al. | |
| D277,724 | S | 2/1985 | Daenen et al. | |
| D278,115 | S | 3/1985 | Leininger | |
| 4,620,642 | A * | 11/1986 | Wertz et al. | 220/791 |
| 4,724,977 | A | 2/1988 | Cleevely et al. | |

(Continued)

FOREIGN PATENT DOCUMENTS

| | | |
|---|---|---|
| CA | 771996 | 11/1967 |

(Continued)

*Primary Examiner*—Robin Hylton
(74) *Attorney, Agent, or Firm*—Alston & Bird LLP

(57) ABSTRACT

A container cover comprises a central dome, a peripheral rim portion surrounding the central dome, wherein the central dome extends upwardly from the peripheral rim portion, a skirt extending downwardly from an outer edge of the peripheral rim portion, and a plurality of grippers. Each gripper comprises a flange extending downwardly from a lower surface of the peripheral rim portion and at least two gripping fingers extending downwardly from the flange. The skirt and the grippers form a space for receiving an edge protrusion, for example a curled edge, of a container body. Each of the at least two fingers has a protrusion extending toward the skirt and the fingers are adapted to provide a gripping force to an edge protrusion of a container received in the space. The plurality of grippers are spaced from one another around the peripheral rim portion. The container cover may be combined with a container body having an edge protrusion at its opening.

22 Claims, 8 Drawing Sheets

U.S. PATENT DOCUMENTS

| | | | | | |
|---|---|---|---|---|---|
| 4,759,478 | A | | 7/1988 | Richardson et al. | |
| D319,786 | S | | 9/1991 | Rayner | |
| 5,069,357 | A | * | 12/1991 | Anderson | 220/787 |
| 5,211,305 | A | | 5/1993 | Horton | |
| D348,834 | S | | 7/1994 | Wardell, Jr. | |
| 5,397,013 | A | | 3/1995 | Adams et al. | |
| 5,558,346 | A | * | 9/1996 | Hartery | 220/787 |
| 5,657,894 | A | * | 8/1997 | Bowen | 220/837 |
| D397,035 | S | | 8/1998 | Young et al. | |
| 6,068,153 | A | | 5/2000 | Young et al. | |
| 6,523,713 | B1 | * | 2/2003 | Helms | 220/831 |

FOREIGN PATENT DOCUMENTS

| | | | |
|---|---|---|---|
| EP | 0144855 | A2 * | 6/1985 |

* cited by examiner

CONTAINER COVER FOR CONTAINER WITH EDGE PROTRUSION

FIELD OF THE INVENTION

The present invention is directed to container covers, and more particularly, to container covers adapted for use with container bodies having an edge protrusion at the periphery of the opening to be covered, and to containers comprising a container cover and a container body. In one embodiment, the container covers of the present invention are particularly adapted for use with fiber board container bodies having an inwardly directed curl at the periphery of the opening to be covered.

BACKGROUND OF THE INVENTION

Numerous container covers have been developed for use with various types of containers. Many such covers are particularly adapted for use with a particular type of container, for example metal drums, fiber board containers and the like. For example, the Young et al U.S. Pat. No. 6,068,153 discloses a dispensing cover for use with a fiber board drum. The Young et al cover is disclosed as a dispensing cover having a resealable lid for dispensing product. The cover is provided with a plurality of barbs which permit the cover to be securely and permanently retained in place, without taping, to avoid spillage problems which are disclosed as common in the prior art.

Fiber board containers are used for different products and the use of such containers with a dispensing cover, namely a cover having a dispensing opening, is often desirable to allow convenient use by consumers. Accordingly, additional improvements for facilitating consumer use of such products are desired.

SUMMARY OF THE INVENTION

Accordingly, it is an object of the present invention to provide improved container covers, and to provide improved containers. It is further object of the invention to provide container covers which are advantageous for use with containers having an edge protrusion, for example a curled edge or bead, at the periphery of an opening to be covered. These and additional objects are satisfied by the container covers and containers according to the invention.

In one embodiment, the invention is directed to a container cover comprising a central dome, a peripheral rim portion surrounding the central dome, wherein the central dome extends upwardly from the peripheral rim portion, a skirt extending downwardly from an outer edge of the peripheral rim portion, and a plurality of grippers. Each gripper comprises a flange extending downwardly from a lower surface of the peripheral rim portion and at least two gripping fingers extending downwardly from the flange. The skirt and the grippers form a space for receiving an edge protrusion of a container. Each of the at least two fingers has a protrusion extending toward the skirt, and the fingers are adapted to provide a gripping force to an edge protrusion of a container received in the space. The plurality of grippers are spaced from one another around the peripheral rim portion.

In another embodiment, the invention is directed to a container cover formed of molded plastic and comprising a central dome including a hinged closure for at least one opening provided in the container cover, a peripheral rim portion surrounding the central dome, wherein the central dome extends upwardly from the peripheral rim portion, a skirt extending downwardly from an outer edge of the peripheral rim portion, and a plurality of grippers. Each gripper comprises a flange extending downwardly from a lower surface of the peripheral rim portion and at least two gripping fingers extending downwardly from the flange. The skirt and the grippers form a space for receiving an edge protrusion of a container. Each of the fingers has a protrusion extending toward the skirt, and the fingers are adapted to provide a gripping force to an edge protrusion of a container received in the space. The plurality of grippers are spaced from one another around the peripheral rim portion.

In a further embodiment, the invention is directed to a container comprising a container body provided with a container body opening at its upper end and including an edge protrusion around the periphery of the container body opening, and a container cover covering the container body opening. The container cover comprises a central dome, a peripheral rim portion surrounding the central dome, wherein the central dome extends upwardly from the peripheral rim portion, a skirt extending downwardly from an outer edge of the peripheral rim portion, and a plurality of grippers. Each gripper comprises a flange extending downwardly from a lower surface of the peripheral rim portion and at least two gripping fingers extending downwardly from the flange. The skirt and the grippers form a space in which the edge protrusion of the container body is received. Each of the at least two fingers has a protrusion extending toward the skirt, and the fingers provide a gripping force to the edge protrusion of the container received in the space. The plurality of grippers are spaced from one another around the peripheral rim portion.

The container covers according to the present invention are advantageous in that they are adapted for secure placement over the opening of a container, particularly a container having an edge protrusion, for example, a curled edge or bead at the periphery of the opening to be covered. However, the configuration of the container cover according to the invention allows removal of the entire container cover from the container if desired, for example, for bulk dispensing of container contents through the opening, without destruction of the container edge protrusion, thereby allowing resecurement of the container cover once the bulk dispensing of product is completed. These and additional objects and advantages will become more fully apparent in view of the following detailed description.

BRIEF DESCRIPTION OF THE DRAWINGS

The following detailed description will be more fully understood in view of the drawing in which.

Figure 1:
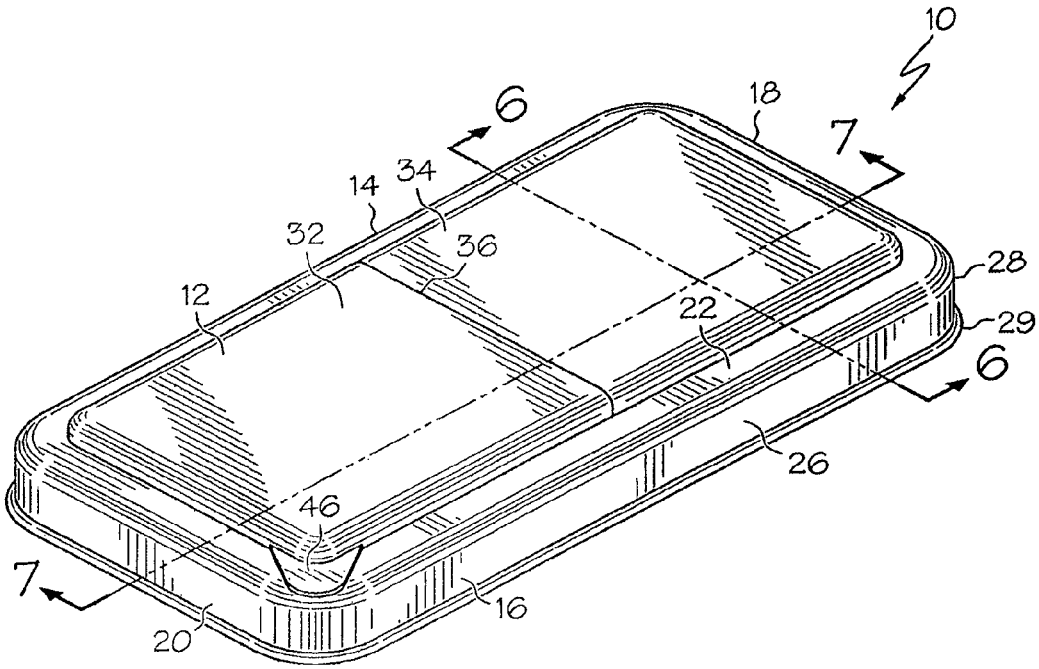
FIG. 1 is a front isometric view of a first embodiment of a container cover according to the present invention.

The embodiments set forth in the drawing are illustrative in nature and are not intended to be limiting of the invention defined by the claims. Moreover, individual features of the drawing and the invention will be more fully apparent and understood in view of the detailed description. Within the following detailed description, like reference numerals are used in the various figures to designate like elements.

DETAILED DESCRIPTION

Figure 2:
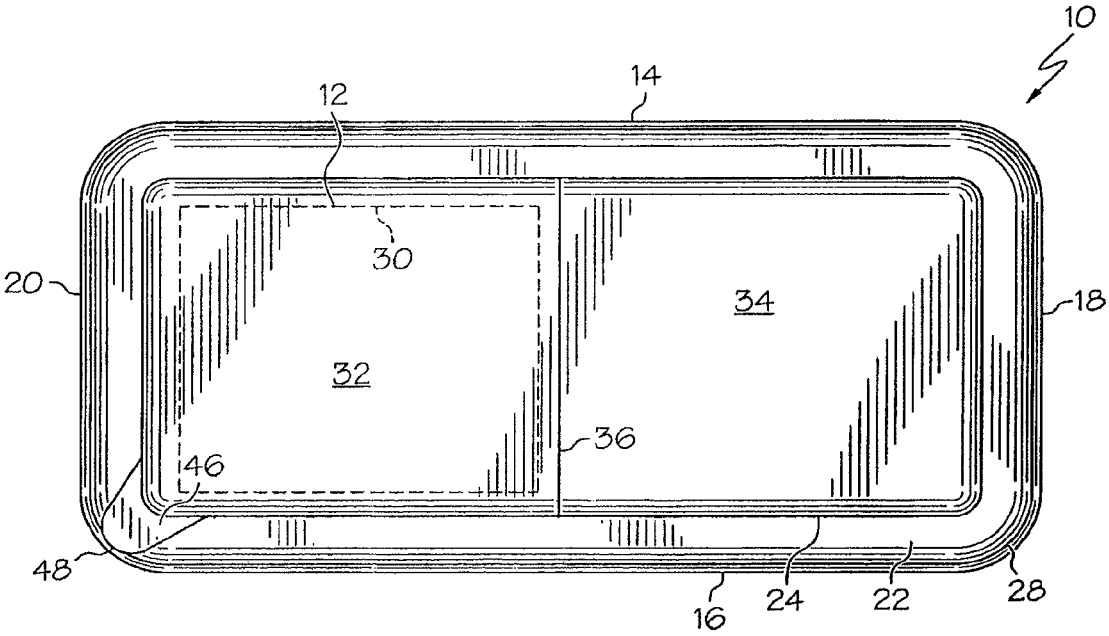
FIG. 2 is a top view of the container cover of FIG. 1.
Figure 3:
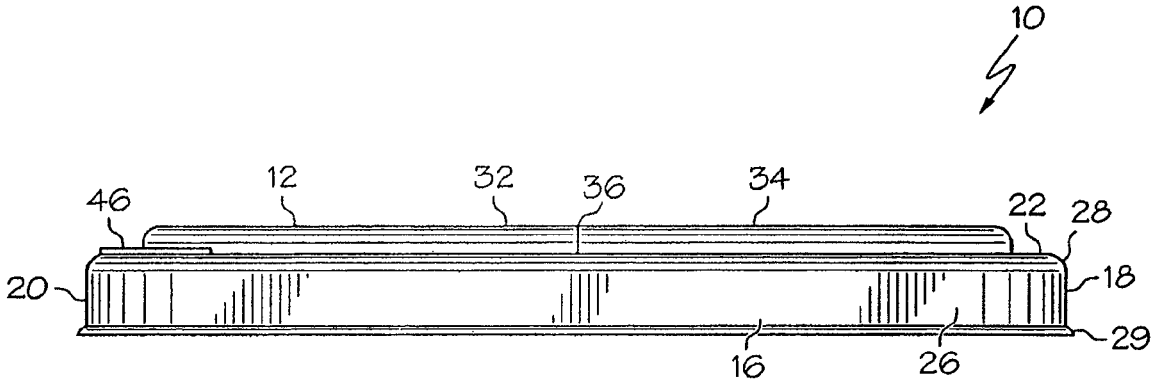
FIG. 3 is a front view of the container cover of FIG. 1.
Figure 4:
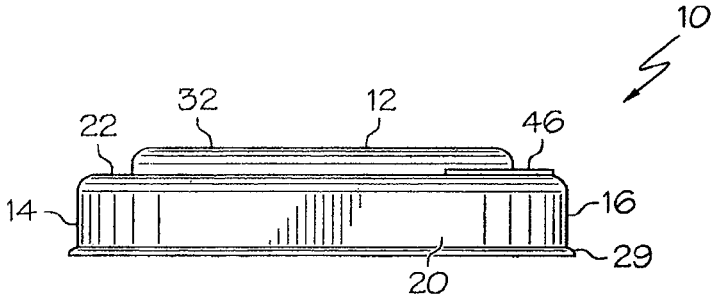
FIG. 4 is an end view of the container cover of FIG. 1.

The present invention is directed to a container cover and, in one embodiment, to a container cover which is adapted for use with a container body having an edge protrusion at the periphery of an opening to be covered. In the present discussion of exemplary embodiments, the container body edge protrusion comprises a curled edge at the periphery of the opening to be covered, but it will be recognized that the container cover as described herein may be similarly combined with a container body having various other protrusion configurations. FIG. 1 shows an isometric view of a first embodiment of such a container cover 10. FIGS. 2, 3 and 4 show top, front and end views of the container cover 10 shown in FIG. 1. The container cover may be formed of any suitable material and, in one embodiment, is formed of molded plastic. Any suitable plastic may be employed, and in a specific embodiment, a polyolefin-based plastic is used. For example, the container cover may be molded of a plastic composition comprising polyethylene, polypropylene, mixtures thereof, or the like, although other polymers known in the art may also be employed in combination with these materials or in place of these materials. Conventional polymer additives may also be included in such compositions. The present container cover may be formed by any technique known in the art. For example, the container cover may be formed using injection molding techniques or the like.

In the embodiment of FIGS. 1-4, the container cover 10 has a generally rectangular shape as shown particularly in the top view of FIG. 2. Thus, the container cover has two pairs of opposed sides 14, 16 and 18, 20 with rounded corners connecting the respective sides. The container cover may have any desired shape and, for example, may take the form of other polygons, for example triangular, pentagonal or hexagonal shapes, or may be of a substantially rounded configuration, for example circular, oval, elliptical or the like.

As shown in FIGS. 1-4, the container cover includes a central dome 12 and a peripheral rim portion 22 surrounding the central dome 12. The central dome extends upwardly from the peripheral rim portion, for example at an inner edge 24 of the peripheral rim portion. In one embodiment, the central dome is substantially raised above the remaining portions of the container cover and, preferably, the container cover portion enclosed by the peripheral rim portion does not contain any concavity in which water, debris, or the like can settle. For example, in the embodiments shown in the figures, the central dome has a substantially planar center portion free of concavities or depressions in which water, debris or the like can accumulate.

In one embodiment, the container cover is provided with at least one opening which allows dispensing of a product therethrough. In the container cover shown in FIGS. 1-4, an opening 30, shown in phantom in FIG. 2, is provided. The bottom view of the container cover shown in FIG. 5 more clearly shows the opening 30 provided in the container cover. In order to allow repeated opening and closing of the opening, the container cover may include a re-closable closure for the opening. For example, as shown in FIG. 1, the central dome includes a closure 32 for the opening 30. The closure may be fully removable from the remainder of the container cover, or may be connected to an adjacent portion of the container cover by any suitable connector, for example by a hinge. In a more specific embodiment, as shown in FIGS. 1-3, the closure 32 is connected with an adjacent portion of the central dome 34 by means of a hinge at hinge line 36 which extends across the central dome, from one side to the opposite side thereof.

Figure 5:
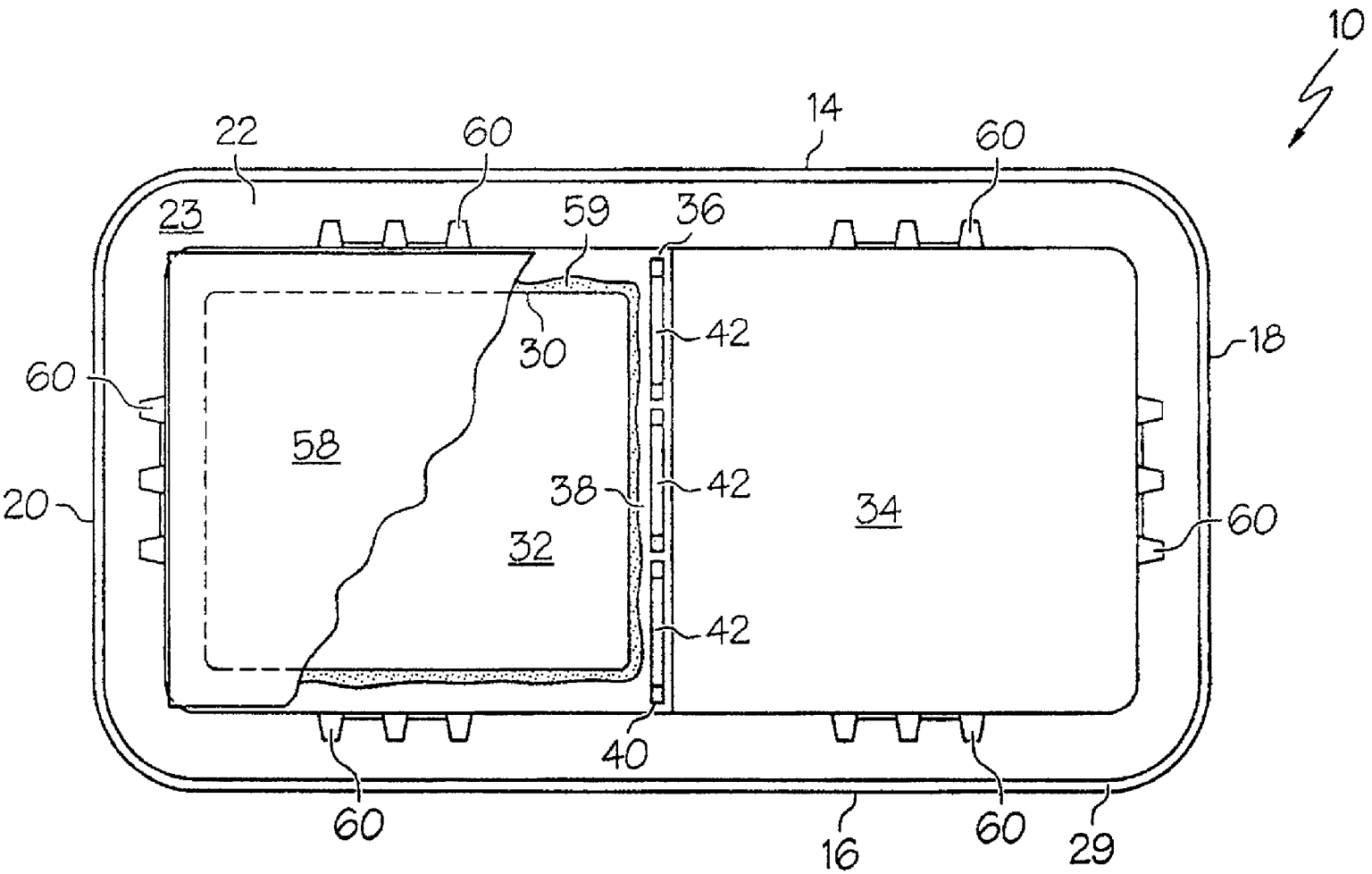
FIG. 5 is an enlarged bottom view of the container cover of FIG. 1.

In this embodiment, the hinge comprises a resilient hinge which is more fully observed in the bottom view of the container cover set forth in FIG. 5. More specifically, a periphery 38 of the opening 30 is provided with a slot 40 at the hinge line 36. Flanges 38 extend from the closure 32 downwardly into the slot 40 and are secured therein, for example by force fit, heat seal, adhesive, combinations thereof, or the like. The closure 32 is pivotable at the hinge line 36 where the flanges 42 connect with the closure 32. Other hinge constructions may be employed, including, but not limited to, a pinned hinge or a one piece living hinge. Additionally, one of ordinary skill in the art will appreciate that the closure 32 may be provided with any known connection which allows repeated opening and closing of the closure to allow dispensing of a product and subsequent closing of the opening 30 when product dispensing is completed.

Figure 10:
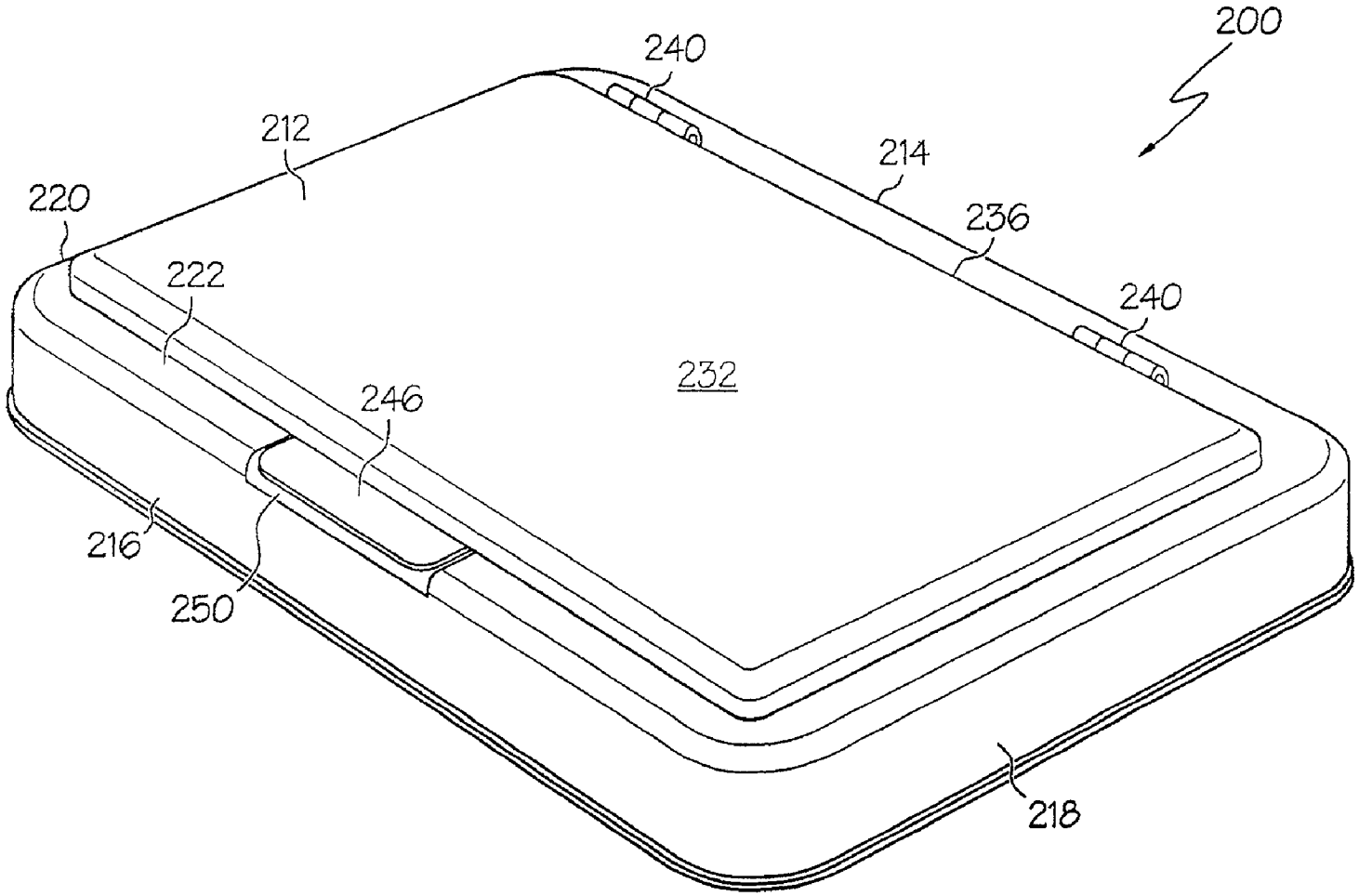
FIG. 10 is an isometric view of a second embodiment of a container cover according to the present invention.
Figure 11:
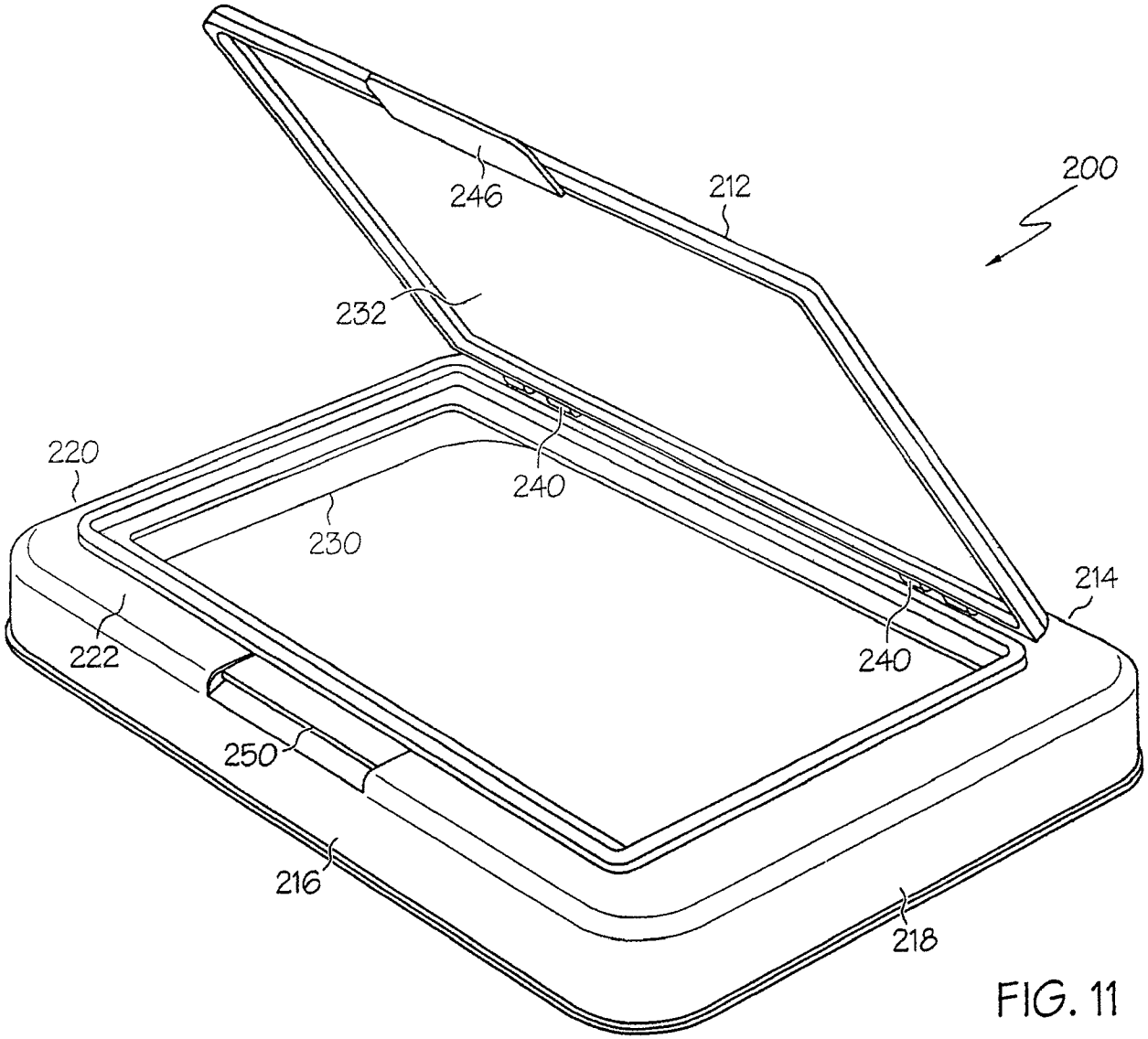
FIG. 11 is an isometric view of the container cover set forth in FIG. 10, with its closure shown in the open position.

FIGS. 10 and 11 disclose a second embodiment of a container cover according to the present invention, also having a generally rectangular configuration. The container 200 includes pairs of opposed sides 214, 216 and 218, 220. The container cover includes a central dome 212 which also serves as a closure 232 for an opening 230 provided in the container cover. The cover includes hinges 240 which allows pivoting of the closure 232 around a hinge line 236 as shown in FIG. 11. In this embodiment, the hinge line 236 extends along an edge of the central dome.

In one embodiment, the container cover may further include a removable membrane seal which covers the container cover opening, for example prior to any dispensing of product from the container. Such a membrane seal may be advantageous in maintaining a substantially moisture-free environment in the container and/or preventing product from inadvertently opening closure 32 during shipment and/or initial storage of a container. For example, such a seal 58 is shown in FIG. 5 secured by an adhesive 59 to a lower surface of the periphery 38. Other means for securing the seal may also be employed, including, but not limited to, a heat seal. In FIG. 5, a portion of the seal 58 has been removed from the lower surface of the periphery 38 around opening 30. Remnants of the adhesive 59 with which the seal 58 is secured to the periphery 38 may be observed. The seal 58 may be formed of any desirable material, for example paper, coated paper, plastic film, foil, or any combinations thereof. In specific embodiments, the seal comprises plastic, paper/foil/plastic/laminate, or plastic/paper laminate. Other materials suitable for use in forming seal 58 will also be apparent to one of ordinary skill in the art and may be employed herein. Advantageously, the seal 58 is applied to the container cover opening prior to assembly of the container cover on a container body.

In another embodiment, the container cover may include a knockout panel in the area of opening 30. For example, a knockout panel may be formed integrally with the periphery 38, optionally with a weakened punch line, scored punch line, or the like, to facilitate removal of the knockout panel by a consumer.

In one embodiment, the closure may be provided with an opening tab or the like to facilitate opening and/or closing of the closure over the container cover opening. For example, as shown in FIG. 1, the closure 32 of the container cover 10 is provided with a tab 46 which extends at its distal end 48 slightly beyond the adjacent peripheral rim portion 22 (see FIG. 2), to facilitate opening of the closure 32. Similarly, in the container cover 200 shown in FIGS. 10 and 11, the closure 232 is provided with a tab 246. In the embodiment shown in FIGS. 10 and 11, the peripheral rim portion 222 is provided with an indentation 250 which facilitates easy handling of the tab 246 to open the closure 232 to the position shown in FIG. 11.

The container cover of the invention further includes a skirt extending downwardly from the peripheral edge portion. For example, the container cover 10 further includes a skirt 26 extending downwardly from an outer edge 28 of the peripheral rim portion. As shown in FIG. 3, the outer edge of the peripheral rim portion may be rounded to provide a smooth transition from the peripheral rim portion to the downwardly extending skirt 26. The skirt may be flared at its lower end, as at 29, for aesthetic purposes, or to facilitate removal of the entire cover from a container, as will be discussed in further detail hereafter.

Figure 6:
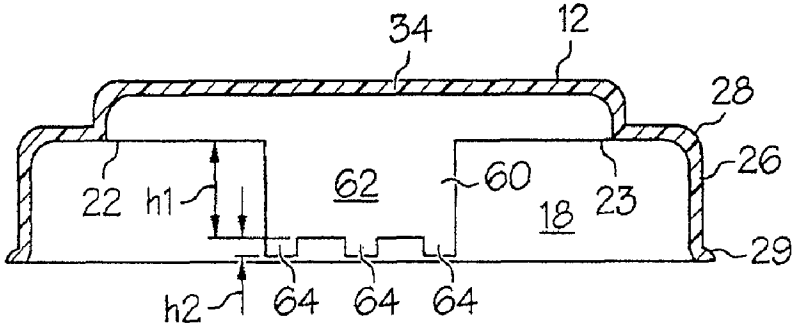
FIG. 6 is a cross-sectional view of the container cover of FIG. 1, taken along line 6-6.
Figure 7:
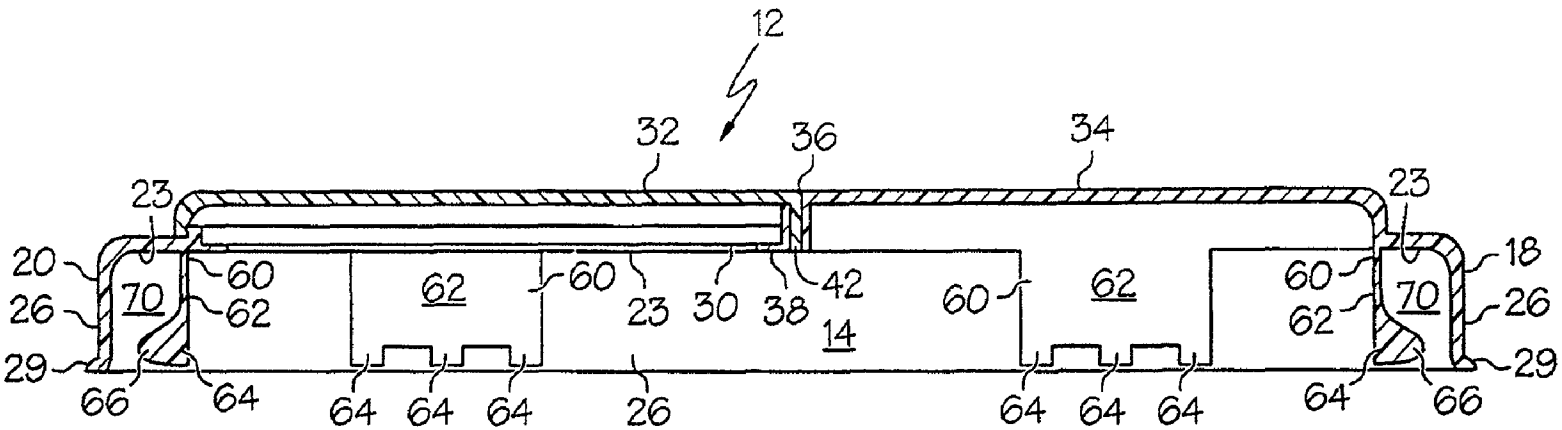
FIG. 7 is a cross-sectional view of the container cover of FIG. 1 taken along line 7-7.

As best shown in the bottom view of FIG. 5 and the cross-sectional views of FIGS. 6 and 7, the container cover further comprises a plurality of grippers 60 extending downwardly from a lower surface 23 of the peripheral edge portion. By a plurality is meant at least two, with the upper number of grippers 60 being determined by the overall dimensions of the container cover and a container body with which the cover is to be used. When the container cover has a generally polygonal shape, for example as set forth in FIGS. 1 and 10, it is generally desirable, but not required, for each polygonal side of the container to be provided with at least one gripper 60. While the embodiment of the container cover illustrated in FIGS. 5-7 includes a single gripper 60 at each of opposed sides 18 and 20 and two grippers on each of opposed sides 14 and 16, any desirable number of grippers spaced from one another around the peripheral rim portion may be employed in order to secure the cover over the opening of a container as desired.

With particular reference to FIGS. 6 and 7, each gripper 60 comprises a flange 62 extending downwardly from the lower surface 23 of the peripheral rim portion 22 and at least two gripping fingers 64 extending downwardly from the flange 62. In one embodiment, at least one gripper has at least three fingers, while, in another embodiment, each gripper has at least three fingers, as shown in FIGS. 5-7. As will be apparent, the vertical height h1 of the flange 62 and the vertical height h2 of the finger 64 may be varied in order to increase or decrease the resiliency of the fingers 64 and in turn increase or decrease the force needed to remove a curled edge held by the grippers, as discussed below.

As shown in FIG. 7, the grippers 60 and the skirt 26 form a space 70 for receiving an edge protrusion, for example a curled edge, of a container body. Additionally, each finger 64 includes a protrusion 66 which interferes with a lower portion of the space 70 and, when a curled edge or other edge protrusion of a container body is inserted into space 70, provides a gripping force to the curled edge to assist in retaining the curled edge within space 70.

Figure 8:
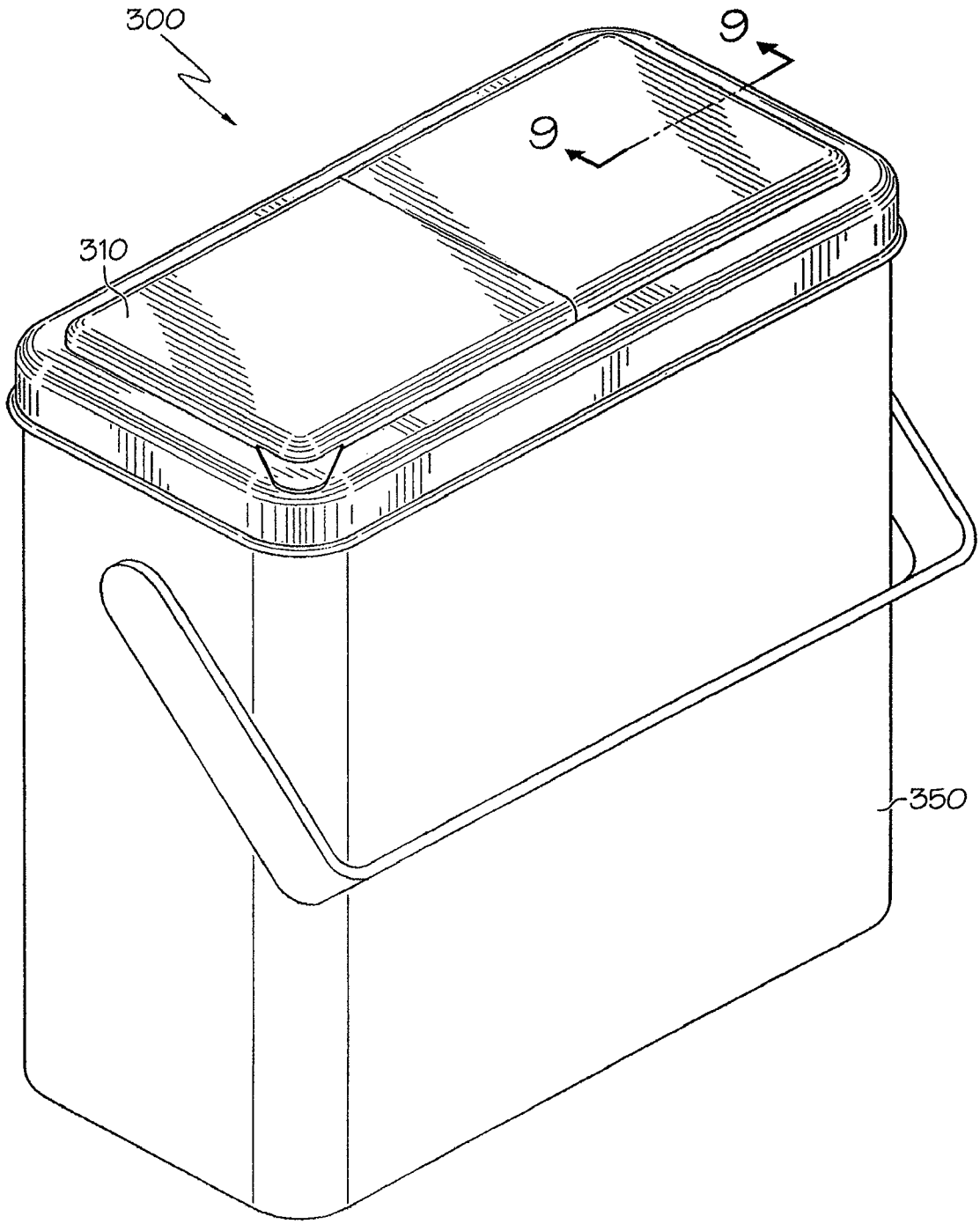
FIG. 8 is an isometric view of a first embodiment of a container according to the present invention.
Figure 9:
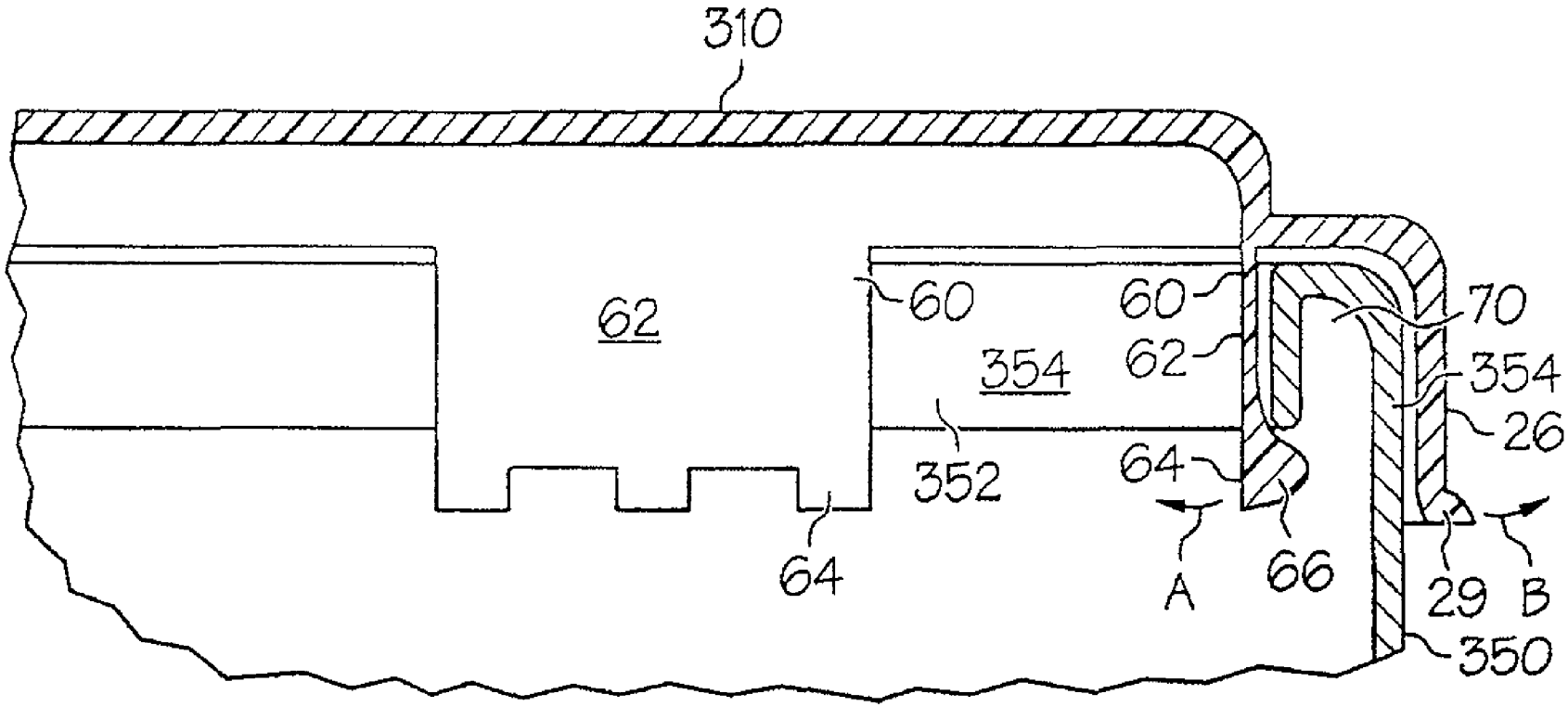
FIG. 9 is a partial cross-sectional view of the container of FIG. 8 taken along line 9-9.

In this regard, attention is directed to FIGS. 8 and 9 which show a container according to one embodiment of the present invention. The container 300 includes a container cover 310 and a container body 350. In the embodiment shown in FIGS. 8 and 9, the container body 350 comprises a fiberboard container body which is provided with a container opening 352 at its upper end and which includes a curled edge 354 around the periphery of the container opening. As shown in FIG. 9, the curled edge 354 is an inwardly curled edge. To secure the container cover 310 on the container body 350, the curled edge 354 is inserted past the protrusion 66 on finger 64 of the grippers 60 into the space 70 formed between the grippers 60 and the skirt 26. As the curled edge passes the fingers 64 and pushes on protrusions 66, the fingers 64 temporarily bend away from skirt 26 in the direction shown by arrow A in FIG. 9. Once the curled edge 354 passes the protrusions 66, the resiliency of the fingers 64 causes the protrusions to resume the position shown in FIG. 9 and provide a gripping force to retain the curled edge received in the space 70. As a result, the container cover 310 is secured to the container body 350 and will resist unintentional removal from the container to avoid spillage of container contents.

However, owing to the configuration of the grippers 60 and the spacing of the grippers 60 around the peripheral rim portion, the container cover may be entirely removed from the container body when desired, for example for bulk dispensing of product from the container. That is, there may be instances wherein a consumer desires to remove a significant portion of the product from the container and dispensing of such a product amount through the container cover opening 30 may require an excessive amount of time, so that it is desirable to remove the entire container cover from the container body and facilitate quick dispensing of a desired amount of product. In this instance, the flanged edge 29 at the lower portion of the skirt 26 of the container cover may be used to apply force to the skirt 26 in a direction shown by arrow B and thereby increase the space between the skirt 26 and the protrusions 66 of the gripping fingers 64 to allow removal of the curled edge of the container from the space 70. Removal of the container cover may be facilitated by initiating removal at one end of the container and then successfully proceeding along the container to adjacent grippers. As a result, the container cover may be removed from the container, without destruction of the curled edge, or otherwise substantially effecting the integrity of the container body, whereby the container cover may then be resecured over the opening once bulk dispensing of the product from the container has been completed.

While the described container embodiment has included a fiberboard container with a curled edge, it is equally within the scope of the invention that the container body may be formed with other types of edge protrusions and/or of other materials including, for example, molded plastic. In such a container, the upper opening may be commonly be provided with a protrusion in the form of a bead, rather than a curled edge as is commonly employed in fiberboard container bodies. Such a container body may similarly be employed in combination with a container cover as described herein, wherein the bead is received within the space 70 formed between the grippers 60 and the skirt 26. Additionally, it is equally within the scope of the present invention that, in addition, structural elements other than grippers as described herein extend from the lower surface of the peripheral rim portion.

While particular embodiments of the present invention have been illustrated and described, it is obvious to those skilled in the art that various other changes and modifications can be made without departing from the spirit and scope of the invention. It is therefore intended to cover in the appended claims all such changes and modifications that are within the scope of this invention.

What is claimed is:

1. A container cover, comprising:

a central dome, a peripheral rim portion surrounding the central dome, wherein the central dome extends upwardly from the peripheral rim portion, a skirt extending downwardly from an outer edge of the peripheral rim portion, and a plurality of grippers, each gripper comprising a flange extending downwardly from a lower surface of the peripheral rim portion and terminating at a lower edge of the flange, and at least two spaced-apart gripping fingers extending downwardly from the lower edge of the flange, wherein the skirt and the grippers form a space therebetween for receiving an edge protrusion of a container, each of the fingers has a protrusion extending toward the skirt, the fingers are adapted to provide a gripping force to an edge protrusion of a container received in the space, and the plurality of grippers are spaced from one another around the peripheral rim portion.

2. The container cover of claim 1, having a generally polygonal shape.

3. The container cover of claim 2, having a generally rectangular shape.

4. The container cover of claim 2, wherein at least one gripper is provided on each polygonal side of the peripheral rim portion.

5. The container cover of claim 1, wherein the fingers have resiliency.

6. The container cover of claim 5, wherein the grippers extending toward the skirt at they extend downwardly from the lower surface of the peripheral rim portion.

7. The container cover of claim 5, wherein the skirt has resiliency.

8. The container cover of claim 1, wherein at least one gripper has at least three fingers.

9. The container cover of claim 1, wherein each gripper has at least three fingers.

10. The container cover of claim 1, provided with at least one opening, wherein the central dome includes a closure for the opening.

11. The container cover of claim 10, wherein the closure comprises a hinged closure.

12. The container cover of claim 11, wherein the hinge extends across the central dome.

13. The container cover of claim 11, wherein the hinge extends along an edge of the central dome.

14. The container cover of claim 11, further comprising a removable seal covering the opening.

15. The container cover of claim 14, wherein the seal is adhesively adhered to a lower surface periphery adjacent the opening.

16. The container cover of claim 11, wherein the closure includes an opening tab extending beyond the peripheral rim portion.

17. The container cover of claim 1, wherein the central dome includes a substantially planar center portion.

18. A container cover, formed of molded plastic and comprising:

a central dome, including a hinged closure for at least one opening in the container cover, a peripheral rim portion surrounding the central dome, wherein the central dome extends upwardly from the peripheral rim portion, a skirt extending downwardly from an outer edge of the peripheral rim portion, and a plurality of grippers, each gripper comprising a flange extending downwardly from a lower surface of the peripheral rim portion and terminating at a lower edge of the flange, and at least two spaced-apart gripping fingers extending downwardly from the lower edge of the flange, wherein the skirt and the grippers form a space therebetween for receiving an edge protrusion of a container, each of the fingers has a protrusion extending toward the skirt, the fingers are adapted to provide a gripping force to an edge protrusion of a container received in the space, and the plurality of grippers are spaced from one another around the peripheral rim portion.

19. The container cover of claim 18, further comprising a removable seal covering the opening, wherein the seal is adhesively adhered to a lower surface periphery of the opening.

20. A container, comprising:

a container body provided with a container body opening at its upper edge and including an edge protrusion around the periphery of the container body opening, and a container cover covering the container body opening, the container cover comprising:

a central dome, a peripheral rim portion surrounding the central dome, wherein the central dome extends upwardly from the peripheral rim portion, a skirt extending downwardly from an outer edge of the peripheral rim portion, and a plurality of grippers, each gripper comprising a flange extending downwardly from a lower surface of the peripheral rim portion and terminating at a lower edge of the flange, and at least two spaced-apart gripping fingers extending downwardly from the lower edge of the flange, wherein the skirt and the grippers form a space therebetween in which the edge protrusion of the container body is received, each of the fingers has a protrusion extending toward the skirt, the fingers provide a gripping force to the edge protrusion of the container body received in the space, and the plurality of grippers are spaced from one another around the peripheral rim portion.

21. The container of claim 20, wherein the edge protrusion of the container body comprises an inwardly rolled bead.

22. The container of claim 21, wherein the container body is formed of fiberboard.

* * * * *